US010896654B2

(12) United States Patent
Li

(10) Patent No.: US 10,896,654 B2
(45) Date of Patent: Jan. 19, 2021

(54) GOA CIRCUIT AND LIQUID CRYSTAL DISPLAY DEVICE

(71) Applicant: Shenzhen China Star Optoelectronics Technology Co., Ltd., Guangdong (CN)

(72) Inventor: Wenying Li, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 190 days.

(21) Appl. No.: 15/578,524

(22) PCT Filed: Aug. 3, 2017

(86) PCT No.: PCT/CN2017/095743

§ 371 (c)(1),
(2) Date: Jul. 31, 2018

(87) PCT Pub. No.: WO2019/006812

PCT Pub. Date: Jan. 10, 2019

(65) Prior Publication Data

US 2020/0043436 A1 Feb. 6, 2020

(30) Foreign Application Priority Data

Jul. 4, 2017 (CN) ..... 2017 1 0537062

(51) Int. Cl.
*G09G 3/36* (2006.01)

(52) U.S. Cl.
CPC ..... *G09G 3/3696* (2013.01); *G09G 3/3655* (2013.01); *G09G 3/3688* (2013.01)

(58) Field of Classification Search
CPC ... G09G 3/3696; G09G 3/3655; G09G 3/3688
See application file for complete search history.

(56) References Cited

U.S. PATENT DOCUMENTS

| | | | | |
|---|---|---|---|---|
| 9,324,288 | B1 * | 4/2016 | Dai | G09G 3/3677 |
| 9,501,989 | B2 * | 11/2016 | Xiao | G11C 19/28 |
| 10,332,468 | B2 * | 6/2019 | Xu | G09G 3/3677 |
| 2003/0189542 | A1 * | 10/2003 | Lee | G09G 3/3677 345/93 |
| 2007/0057899 | A1 | 3/2007 | Yamashita | |
| 2009/0304138 | A1 * | 12/2009 | Tsai | G11C 19/28 377/79 |
| 2010/0158188 | A1 * | 6/2010 | Lee | G11C 19/28 377/79 |

(Continued)

FOREIGN PATENT DOCUMENTS

| | | | |
|---|---|---|---|
| CN | 106128410 | A | 11/2016 |
| JP | 2009245564 | A | 10/2009 |

*Primary Examiner* — Nitin Patel
*Assistant Examiner* — Robert M Stone

(57) ABSTRACT

Disclosed are a GOA circuit and a liquid crystal display device. The GOA circuit includes multiple stages of GOA sub-circuits connected in cascade. In a pull-down unit of a GOA sub-circuit, a first thin film transistor and a second thin film transistor are connected in series. Leakage current at Q point in the GOA circuit can be reduced, stability of the GOA circuit can be improved in harsh environments, and reliability of a liquid crystal panel can be enhanced.

16 Claims, 5 Drawing Sheets

(56) References Cited

U.S. PATENT DOCUMENTS

2010/0260312 A1* 10/2010 Tsai ..... G09G 3/3677 377/79
2011/0150169 A1* 6/2011 Lin ..... G11C 19/28 377/64
2011/0234577 A1* 9/2011 Yang ..... G11C 19/28 345/212
2012/0153996 A1* 6/2012 Su ..... G09G 3/3659 327/109
2014/0176410 A1* 6/2014 Ma ..... H03K 3/012 345/92
2015/0102990 A1* 4/2015 Kuo ..... G09G 3/3677 345/99
2015/0187312 A1* 7/2015 Dai ..... G11C 19/28 345/213
2015/0255034 A1* 9/2015 Hong ..... G09G 3/3674 345/214
2015/0279288 A1* 10/2015 Dai ..... G09G 3/3607 345/690
2015/0310819 A1* 10/2015 Xiao ..... G11C 19/28 345/212
2015/0348484 A1* 12/2015 Yu ..... G09G 3/3677 345/92
2016/0125824 A1* 5/2016 Dai ..... G11C 19/28 345/213
2016/0125831 A1* 5/2016 Xiao ..... G09G 3/3696 345/92
2016/0126947 A1* 5/2016 Xiao ..... G09G 3/3677 327/109
2016/0126948 A1* 5/2016 Xiao ..... G11C 19/00 327/109
2016/0140922 A1* 5/2016 Dai ..... G09G 3/3677 345/92
2016/0140926 A1* 5/2016 Xiao ..... G09G 3/3677 345/215
2016/0140928 A1* 5/2016 Xiao ..... G09G 3/3648 345/212
2016/0164514 A1* 6/2016 Xiao ..... H03K 17/687 327/109
2016/0180964 A1* 6/2016 Hu ..... G09G 3/3677 345/100
2016/0189649 A1* 6/2016 Xiao ..... G09G 3/3677 345/214
2016/0267864 A1* 9/2016 Xiao ..... G09G 3/3677
2017/0148403 A1* 5/2017 Dai ..... G09G 3/3677
2018/0061307 A1* 3/2018 Inoue ..... G09G 3/3275
2018/0061349 A1* 3/2018 Xu ..... G11C 19/28
2018/0182337 A1* 6/2018 Lv ..... G11C 19/28
2018/0188578 A1 7/2018 Wang et al.
2018/0190231 A1* 7/2018 Shi ..... H01L 29/78603
2018/0218698 A1* 8/2018 Li ..... G09G 3/3677
2018/0261178 A1* 9/2018 Shao ..... G09G 3/3677
2018/0268768 A1* 9/2018 Lv ..... H01L 27/124

* cited by examiner

GOA CIRCUIT AND LIQUID CRYSTAL DISPLAY DEVICE

CROSS-REFERENCE TO RELATED APPLICATIONS

This application claims the priority of Chinese patent application CN 201710537062.X, entitled "GOA circuit and liquid crystal display device" and filed on Jul. 4, 2017, the entirety of which is incorporated herein by reference.

FIELD OF THE INVENTION

The present disclosure relates to the technical field of liquid crystal display, and in particular, to a GOA circuit and a liquid crystal display device.

BACKGROUND OF THE INVENTION

Liquid crystal display devices have advantages of high display quality, low price and portability, and are widely used as display terminals of mobile communication devices, computers, and televisions etc. At present, Gate Driver on Array (GOA) technology has become a commonly used technology for driving a panel of a display device of a television. In the GOA technology, an original manufacturing procedure of a flat display panel is used, and a driving circuit of horizontal scanning lines of a panel is manufactured on a substrate around an active area thereof. In the GOA technology, a manufacturing procedure of a flat display panel can be simplified by omitting a bonding procedure in a direction along the horizontal scanning line. Therefore, production capacity can be improved, and product costs can be reduced. At the same time, an integration rate of a display panel can be enhanced, which is conductive to manufacture of a narrow-frame or frameless display device, so as to meet visual demands of modern people.

In a liquid crystal display device, there is a thin film transistor (TFT) in each pixel. A gate of the thin film transistor is connected to a scanning line, a drain thereof is connected to a data line, and a source thereof is connected to a pixel electrode. A high enough voltage is applied to the scanning line, and thus all thin film transistors on the scanning line would be turned on. At this time, a display signal voltage on the data line would be written to a pixel, so as to control light transmittance of different liquid crystals and further to control colors displayed thereon.

An existing GOA circuit generally comprises multiple stages of GOA units connected in cascade. A GOA unit in each stage drives a horizontal scanning line. Each GOA unit mainly comprises a pull-up part, a pull-up control part, a transfer part, a pull-down part, a pull-down holding part, and a bootstrap capacitor for raising a potential. The pull-up part is mainly configured to output a clock signal as a gate signal. The pull-up control part is configured to control an On time of the pull-up part, and is generally connected to a transfer signal or a gate signal transmitted from a previous-stage GOA unit. The pull-down part is configured to pull down a gate signal to a low level in the first place, i.e., to turn off the gate signal. The pull-down holding part is configured to hold a gate output signal and a gate signal of the pull-up part in an Off state. Generally, two pull-down holding parts operate alternately. The bootstrap capacitor is configured to raise a potential at point Q for a second time, which is conductive to output of G(N) of the pull-up part.

FIG. 1 schematically shows a connecting method of a GOA circuit in multiple stages used in a flat panel in the prior art. Metal lines of a first low-frequency clock signal LC1, a second low-frequency clock signal LC2, a DC low voltage VSS, and four high-frequency clock signals CK1-CK4 are arranged around the GOA circuits in each stage on both left and right sides of a panel. A plurality of data lines that are configured to provide data signals, a plurality of scanning lines that are configured to provide scanning signals, and a plurality of pixels P are arranged in an array. Each of the pixels P is electrically connected to a data line and a scanning line. A plurality of shift registers are arranged in sequence, i.e., S(n−3), S(n−2), S(n−1), and S(n) (which are not shown in FIG. 1). Each of the shift registers is configured to output a gate signal to scan a corresponding gate line in a display device. The shift registers are respectively electrically connected to the first low-frequency clock signal LC1, the second low-frequency clock signal LC2, the DC low voltage VSS, and one of the four high-frequency clock signals CK1-CK4. Specifically, an $n^{th}$ GOA circuit receives the first low-frequency clock signal LC1, the second low-frequency clock signal LC2, the DC low voltage VSS, a high frequency clock signal of the four high-frequency clock signals CK1-CK4, a signal G(n−2) and a start signal ST(n−2) generated by an $(n-2)^{th}$ GOA circuit, and a signal G(n+2) generated by an $(n+2)^{th}$ GOA circuit, and generates signals G(n), ST(n), and Q(n).

FIG. 2 schematically shows a voltage at point Q when an external condition deteriorates. It can be seen from FIG. 2 that, the voltage at point Q cannot be maintained (as shown at A in FIG. 2), which affects driving performance of the GOA circuit.

SUMMARY OF THE INVENTION

The present disclosure provides a GOA circuit and a liquid crystal display device, so as to solve the technical problem in the prior art that a voltage at point Q in a GOA circuit cannot be maintained, thereby affecting driving performance of the GOA circuit.

In one aspect, the present disclosure provides a GOA circuit which comprises multiple stages of GOA sub-circuits connected in cascade. Each of the GOA sub-circuits comprises a pull-up control unit, a pull-up unit, a transfer unit, a pull-down unit, a pull-down holding unit, and a bootstrap unit. The pull-up control unit is connected to a first signal input terminal, a second signal input terminal and a first node, and is figured to output a voltage signal of the second signal input terminal to the first node under control of the first signal input terminal. The pull-up unit is connected to a high-frequency clock signal input terminal, a first signal output terminal and the first node, and is configured to input a clock signal of the high-frequency clock signal input terminal to the first signal output terminal. The transfer unit is connected to the high-frequency clock signal input terminal, the first node and a second signal output terminal, and is configured to provide a voltage signal to a second signal input terminal of a GOA sub-circuit in another stage. The pull-down holding unit is connected to the first node, a DC low-voltage input terminal, a first low-frequency clock signal input terminal, a second low-frequency clock signal input terminal and the first signal output terminal, and is configured to maintain an output signal of the first signal output terminal at a low level. The bootstrap unit is connected to the first node and the first signal output terminal, and is configured to raise a voltage at the first node. The pull-down unit comprises a first thin film transistor, a second thin film transistor, and a third thin film transistor. A first pole, a second pole, and a gate of the first thin film transistor are connected to the first node, a first pole of the second thin film transistor, and a third signal input terminal respectively. A second pole and a gate of the second thin film transistor are connected to the DC low-voltage input terminal and the third signal input terminal respectively. A first pole, a second pole, and a gate of the third thin film transistor are connected to the first signal output terminal, the DC low-voltage input terminal, and the third signal input terminal respectively.

Preferably, the pull-up control unit comprises a fourth thin film transistor and a fifth thin film transistor. A first pole, a second pole, and a gate of the fourth thin film transistor are connected to the first signal input terminal, a first pole of the fifth thin film transistor, and the second signal input terminal respectively. A second pole and a gate of the fifth thin film transistor are connected to the first node and the second signal input terminal respectively.

Preferably, the pull-down holding unit comprises a first pull-down holding circuit and a second pull-down holding circuit. The first pull-down holding circuit is connected to the first node, the DC low-voltage input terminal, the first low-frequency, clock signal input terminal and the first signal output terminal, and is configured to hold the output signal of the first signal output terminal at a low level. The second pull-down holding circuit is connected to the first node, the DC low-voltage input terminal, the second low-frequency clock signal input terminal and the first signal output terminal, and is configured to hold the output signal of the first signal output terminal at a low level.

Preferably, the first pull-down holding circuit comprises a sixth thin film transistor, a seventh thin film transistor, an eighth thin film transistor, a ninth thin film transistor, a tenth thin film transistor, an eleventh thin film transistor, and a twelfth thin film transistor. A first pole, a second pole, and a gate of the sixth thin film transistor are connected to the first node, a first pole of the seventh thin film transistor, and a first pole of the eleventh thin film transistor respectively. A second pole and a gate of the seventh thin film transistor are connected to the DC low-voltage input terminal and the first pole of the eleventh thin film transistor respectively. A first pole, a second pole, and a gate of the eighth thin film transistor are connected to the first signal output terminal, the DC low-voltage input terminal, and the first pole of the eleventh thin film transistor respectively. A first pole and a gate of the ninth thin film transistor both are connected to the first low-frequency clock signal input terminal, and a second pole thereof is connected to a first pole of the twelfth thin film transistor. A first pole, a second pole, and a gate of the tenth thin film transistor are connected to the first low-frequency clock signal input terminal, the first pole of the eleventh thin film transistor, and the first pole of the twelfth thin film transistor respectively. A second pole and a gate of the eleventh thin film transistor are connected to the DC low-voltage input terminal and the first node respectively. A second pole and a gate of the twelfth thin film transistor are connected to the DC low-voltage input terminal and the first node respectively.

Preferably, the second pull-down holding circuit comprises a thirteenth thin film transistor, a fourteenth thin film transistor, a fifteenth thin film transistor, a sixteenth thin film transistor, a seventeenth thin film transistor, an eighteenth thin film transistor, and a nineteenth thin film transistor. A first pole, a second pole, and a gate of the thirteenth thin film transistor are connected to the first node, a first pole of the fourteenth thin film transistor, and a first pole of the eighteenth thin film transistor respectively. A second pole and a gate of the fourteenth thin film transistor are connected to the DC low-voltage input terminal and the first pole of the eighteenth thin film transistor respectively. A first pole, a second pole, and a gate of the fifteenth thin film transistor are connected to the first signal output terminal, the DC low-voltage input terminal, and the first pole of the eighteenth thin film transistor respectively. A first pole and a gate of the sixteenth thin film transistor both are connected to the second low-frequency clock signal input terminal, and a second pole thereof is connected to a first pole of the nineteenth thin film transistor. A first pole, a second pole, and a gate of the seventeenth thin film transistor are connected to the second low-frequency clock signal input terminal, the first pole of the eighteenth thin film transistor, and the first pole of the nineteenth thin film transistor respectively. A second pole and a gate of the eighteenth thin film transistor are connected to the DC low-voltage input terminal and the first node respectively. A second pole and a gate of the nineteenth thin film transistor are connected to the DC low-voltage input terminal and the first node respectively.

Preferably, the transfer unit comprises a twentieth thin film transistor, a first pole, a second pole, and a gate of which are connected to the high-frequency clock signal input terminal, the second signal output terminal, and the first node respectively.

Preferably, the pull-up unit comprises a twenty-first thin film transistor, a first pole, a second pole, and a gate of which are connected to the high-frequency clock signal input terminal, the first signal output terminal, and the first node respectively.

Preferably, the bootstrap unit comprises a capacitor. A first end of the capacitor is connected to the first node, and the second end thereof is connected to the first signal output terminal.

Preferably, the first pole is a drain, and the second pole is a source.

In the other aspect, the present disclosure provides a liquid crystal display device comprising the above GOA circuit.

In the GOA circuit and the liquid crystal display device provided by the present disclosure, the first thin film transistor and the second thin film transistor in the pull-down unit are connected in series. In this manner, leakage current at point Q (i.e, a first node m) in the GOA circuit can be reduced. Moreover, since the first thin film transistor and the second thin film transistor are connected in series, a voltage carried by the first thin film transistor or the second thin film transistor is reduced to a certain extent. Therefore, a deterioration rate of the first thin film transistor or the second thin film transistor can be reduced, and thus a service life thereof can be prolonged. Furthermore, stability of the GOA circuit can be improved in harsh environments, and reliability of a liquid crystal panel can be enhanced.

BRIEF DESCRIPTION OF THE DRAWINGS

The accompanying drawings provide further understandings of the present disclosure and constitute one part of the description. The drawings are used for interpreting the present disclosure together with the embodiments, not for limiting the present disclosure. In the drawings.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no conflict, all the technical features mentioned in all the embodiments can be combined together in any manner; and the technical solutions obtained in this manner all fall within the scope of the present disclosure.

Figure 1:
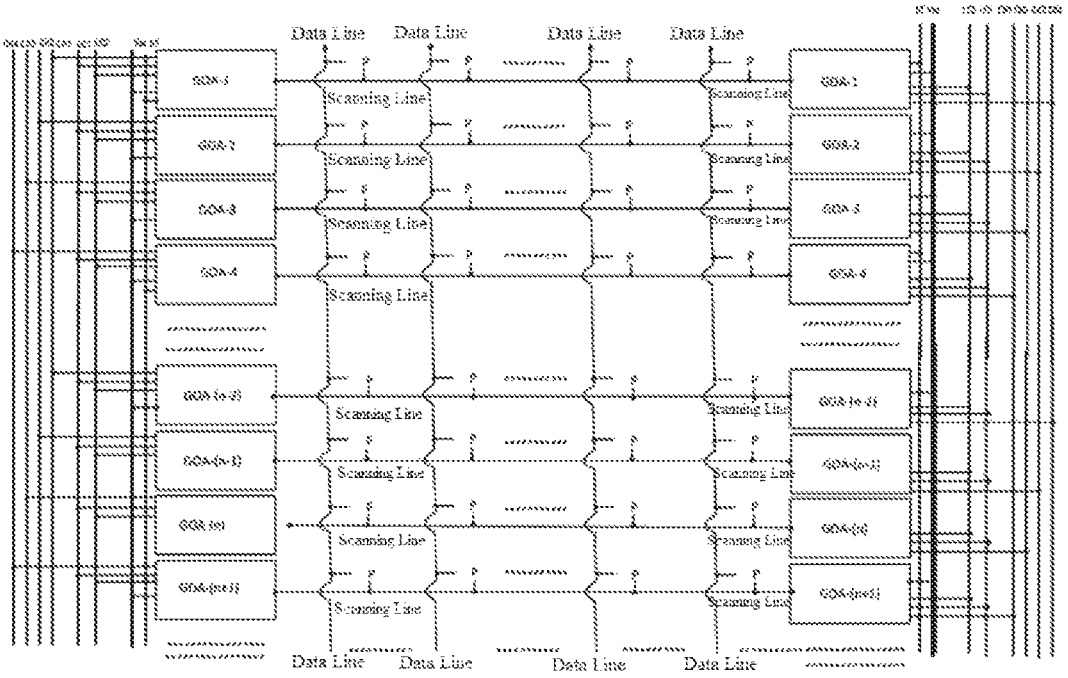
Fig. 1 (Prior Art)
FIG. 1 schematically shows a GOA multiple-stage driving structure in the prior art.
Figure 2:
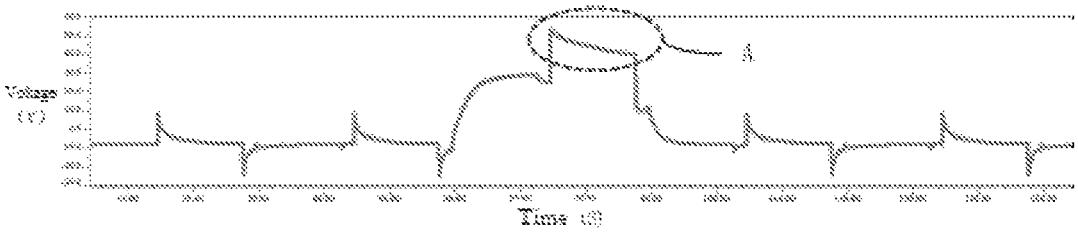
Fig. 2 (Prior Art)
FIG. 2 schematically shows a waveform of a voltage at point Q in a GOA circuit in the prior art.
Figure 3:
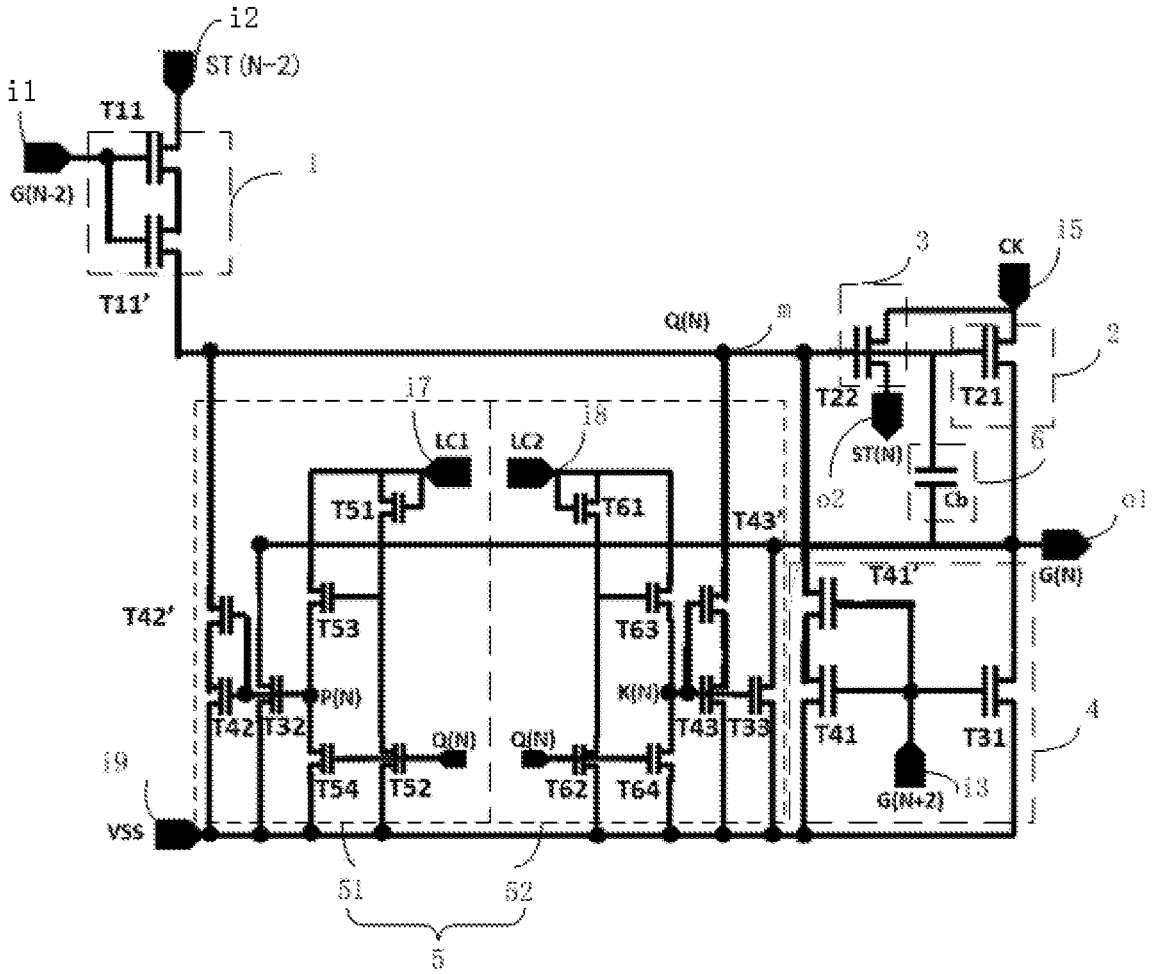
FIG. 3 schematically shows a structure of a GOA sub-circuit according to an embodiment of the present disclosure.

FIG. 3 schematically shows a structure of a GOA sub-circuit according to an embodiment of the present disclosure. As shown in FIG. 3, the present embodiment provides a GOA circuit which comprises multiple stages of GOA sub-circuits connected in cascade. Each of the GOA sub-circuits comprises a pull-up control unit 1, a pull-up unit 2, a transfer unit 3, a pull-down unit 4, a pull-down holding unit 5, and a bootstrap unit 6.

Generally, a GOA circuit comprises a start signal STV, a first low-frequency clock signal LC1, a second low-frequency clock signal LC2, a DC low voltage VSS, and four high-frequency clock signals CK1-CK4. The start signal STV is configured to turn on T11 in an $(N-2)^{th}$ stage and to pull down T31 and T41 in an $(N+2)^{th}$ stage. The low-frequency clock signals LC1 and LC2 operate alternately to maintain a pull-down state of the GOA circuit. In the GOA circuit, when a gate signal is in an Off state, Gn is maintained at a low level. Meanwhile, a gate signal Gn needed by a scanning line outputs a high level mainly by one of the four high-frequency clock signals, so that a gate signal of a display panel can be well turned on. In this way, a data signal can be input to a thin film transistor in a pixel, and thus the pixel can be charged or discharged normally.

According to the present embodiment, four high-frequency clock signals are provided and represented respectively by CK1-CK4. Of course, the number of high-frequency clock signals is not necessarily four, and any other numbers can also be arranged. An $N^{th}$ GOA sub-circuit receives a first low-frequency clock signal LC1, a second low-frequency clock signal LC2, a DC low voltage signal VSS, one of the four high-frequency clock signals CK1-CK4, an $(N-2)^{th}$ gate signal G(N−2) generated by an $(N-2)^{th}$ GOA sub-circuit (the gate signal G(N−2) is output by a first signal output terminal o1 of the $(N-2)^{th}$ GOA sub-circuit), an $(N-2)^{th}$ start signal ST(N−2) (output by a second signal output terminal o2 of the $(N-2)^{th}$ GOA sub-circuit), and an $(N+2)^{th}$ gate signal G(N+2) generated by an $(N+2)^{th}$ GOA sub-circuit (the gate signal G(N+2) is output by a first signal output terminal o1 of the $(N+2)^{th}$ GOA sub-circuit), and generates an $N^{th}$ gate signal G(N), an $N^{th}$ transfer signal ST(N) (i.e., a start signal ST(N) of the $(N+2)^{th}$ GOA sub-circuit), and an $N^{th}$ first node output signal Q(N) at a first node m.

Figure 4:
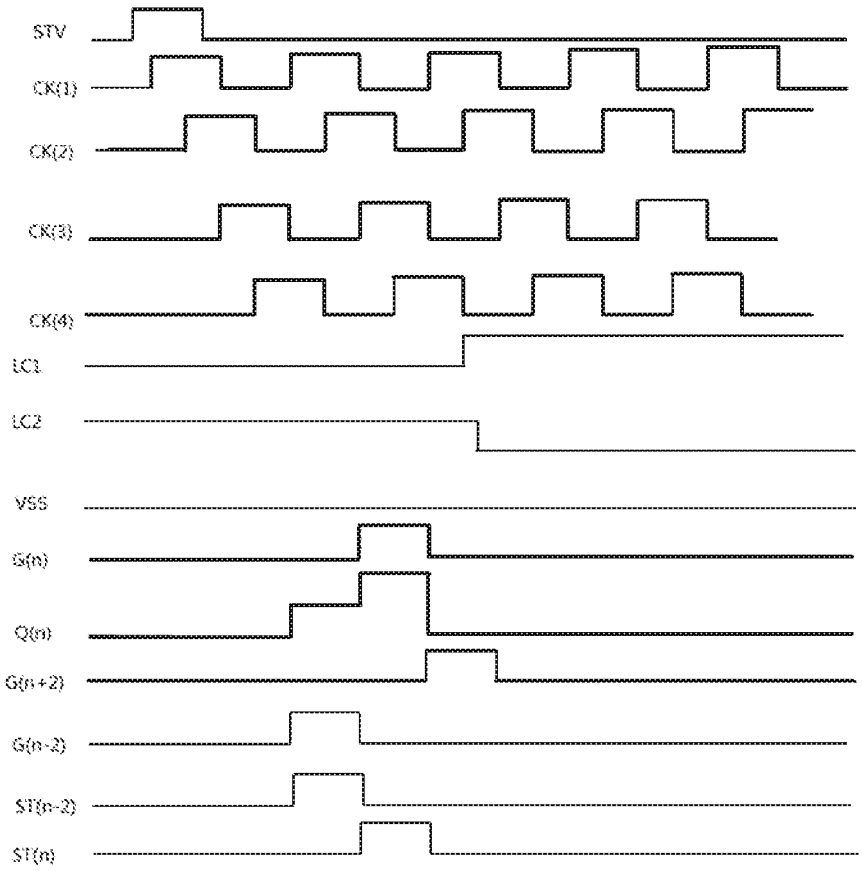
FIG. 4 is a timing diagram of signals according to the embodiment of the present disclosure.

According to the present embodiment, the $N^{th}$ GOA sub-circuit will be explained hereafter as an example. A first signal input terminal i1 is configured to provide an $(N-2)^{th}$ gate signal G(N−2) generated by an $(N-2)^{th}$ GOA sub-circuit. A second signal input terminal i2 is configured to provide an $(N-2)^{th}$ transfer signal ST(N−2) generated by the $(N-2)^{th}$ GOA sub-circuit. A third signal input terminal i3 is configured to provide an $(N+2)^{th}$ gate signal G(N+2) generated by an $(N+2)^{th}$ GOA sub-circuit. A first signal output terminal o1 is configured to output an $N^{th}$ gate signal G(N) generated by the $N^{th}$ GOA sub-circuit. The first signal output terminal o1 is connected to a scanning line to provide the $N^{th}$ gate signal G(N) to an $N^{th}$ scanning line. A second signal output terminal o2 is configured to output an $N^{th}$ transfer signal ST(N) generated by the $N^{th}$ GOA sub-circuit. A first node m is configured to output an $N^{th}$ first node output signal Q(N) generated by the $N^{th}$ GOA sub-circuit. A first low-frequency clock signal input terminal i7 is configured to provide a first low-frequency clock signal LC1. A second low-frequency clock signal input terminal i8 is configured to provide a second low-frequency clock signal LC2. A DC low-voltage input terminal i9 is configured to provide a DC low-voltage signal VSS. A high-frequency clock signal input terminal i5 is configured to provide one of four high-frequency clock signals CK1-CK4. According to the present embodiment, a first signal input terminal i1 of the $(N-2)^{th}$ GOA sub-circuit and a third signal input terminal i3 of the $(N+2)^{th}$ GOA sub-circuit are provided with an external start signal STV. FIG. 4 is a timing diagram of the above described signals. In FIG. 4, CK(1), CK(2), CK(3), and CK(4) represent the signal CK1, signal CK2, signal CK3, and signal CK4, respectively.

A pull-up control unit 1 is connected to the first signal input terminal i1, the second signal input terminal i2 and the first node m, and is configured to output a voltage signal of the second signal input terminal i2 to the first node m under control of the first signal input terminal i1. A pull-up unit 2 is connected to a high-frequency clock signal input terminal i4, the first signal output terminal o1 and the first node m, and is configured to input a clock signal of the high-frequency clock signal input terminal i4 to the first signal output terminal o1.

A transfer unit 3 is connected to the high-frequency clock signal input terminal i4, the first node m and the second signal output terminal o2, and is configured to provide a voltage signal to the second signal input terminal i2 of a GOA sub-circuit in another stage.

A pull-down holding unit 5 is connected to the first node m, the DC low-voltage input terminal i9, the first low-frequency clock signal input terminal i7, the second low-frequency clock signal input terminal i8 and the first signal output terminal o1, and is configured to hold an output signal of the first signal output terminal o1 at a low level.

A bootstrap unit 6 is connected to the first node m and the first signal output terminal o1, and is configured to raise a voltage at the first node m.

A pull-down unit 4 comprises a first thin film transistor T41', a second thin film transistor T41, and a third thin film transistor T31. A first pole, a second pole, and a gate of the first thin film transistor T41' are connected to the first node m, a first pole of the second thin film transistor T41, and a third signal input terminal i3 respectively. A second pole and a gate of the second thin film transistor T41 are connected to the DC low-voltage input terminal i9 and the third signal input terminal i3 respectively. A first pole, a second pole thereof, and a gate of the third thin film transistor T31 are connected to the first signal output terminal o1, the DC low-voltage input terminal i9, and the third signal input terminal i3 respectively. The pull-down unit 4 is configured to pull down an $N^{th}$ gate signal G(N) to a low level, i.e., to turn off the $N^{th}$ gate signal G(N).

In the GOA circuit according to the present embodiment, the first thin film transistor T41' and the second thin film transistor T41 in the pull-down unit 4 are connected in series. That is, the first pole, the second pole, and the gate of the first thin film transistor T41' are connected to the first node m, the first pole of the second thin film transistor T41, and the third signal input terminal i3 respectively, and the second pole and the gate of the second thin film transistor T41 are connected to the DC low-voltage input terminal i9 and the third signal input terminal i3 respectively. In this manner, leakage current at point Q (i.e. the first node m) in the GOA circuit can be reduced. Moreover, since the first thin film transistor T41' and the second thin film transistor T41 are connected in series, a voltage carried by the first thin film transistor T41' or the second thin film transistor T41 is reduced. Therefore, a deterioration rate of the first thin film transistor T41' or the second thin film transistor T41' can be reduced to a certain extent, and thus a service life of the first thin film transistor T41' or the second thin film transistor T41' can be prolonged. Furthermore, stability of the GOA circuit can be improved in harsh environments, and reliability of a liquid crystal panel can be enhanced.

In a specific embodiment of the present disclosure, the pull-up control unit 1 comprises a fourth thin film transistor T11 and a fifth thin film transistor T11'. A first pole, a second pole, and a gate of the fourth thin film transistor T11 are connected to the second signal input terminal i2, a first pole of the fifth thin film transistor T11', and the first signal input terminal i1 respectively. A second pole and a gate of the fifth thin film transistor T11' are connected to the first node m and the first signal input terminal i1 respectively.

In the above described pull-up control unit 1, the fourth thin film transistor T11 and the fifth thin film transistor T11' are also connected to each other in series, and thus the leakage current at point Q can be further reduced. Besides, since the fourth thin film transistor T11 and the fifth thin film transistor T11' are connected in series, a voltage carried by the fourth thin film transistor T11 or the fifth thin film transistor T11' can be reduced. Therefore, a deterioration rate of the fourth thin film transistor T11 or the fifth thin film transistor T11' can be reduced to a certain extent, and thus a service life the fourth thin film transistor T11 or the fifth thin film transistor T11' can be prolonged. Furthermore, stability of the GOA circuit can be improved in harsh environments, and reliability of the liquid crystal panel can be enhanced.

In a specific embodiment of the present disclosure, the pull-down holding unit 5 comprises a first pull-down holding circuit 51 and a second pull-down holding circuit 52. The first pull-down holding circuit 51 is connected to the first node m, the DC low-voltage input terminal i9, the first low-frequency clock signal input terminal i7, and the first signal output terminal o1. The pull-down holding unit 51 is configured to hold an output signal of the first signal output terminal o1 at a low level. The second pull-down holding circuit 52 is connected to the first node m, the DC low-voltage input terminal i9, the second low-frequency clock signal input terminal i8, and the first signal output terminal o1. The second pull-down holding circuit 52 is configured to hold the output signal of the first signal output terminal o1 at a low level. The first low-frequency clock signal LC1 output by the first low-frequency clock signal input terminal i7 and the second low-frequency clock signal LC2 output by the second low-frequency clock signal input terminal i8 operate alternately to maintain a pull-down state of the GOA sub-circuit, so that a gate signal and an output signal of the pull-up unit 2 can be maintained in an Off state.

In another embodiment of the present disclosure, the first pull-down holding circuit 51 comprises a sixth thin film transistor T42', a seventh thin film transistor T42, an eighth thin film transistor T32, a ninth thin film transistor T51, a tenth thin film transistor T53, an eleventh thin film transistor 54, and a twelfth thin film transistor 52. A first pole, a second pole, and a gate of the sixth thin film transistor T42' are connected to the first node m, a first pole of the seventh thin film transistor T42, and a first pole of the eleventh thin film transistor T54 respectively. A second pole and a gate of the seventh thin film transistor T42 are connected to the DC low-voltage input terminal i9 and the first pole of the eleventh thin film transistor T54 respectively. A first pole, a second pole, and a gate of the eighth thin film transistor T32 are connected to the first signal output terminal o1, the DC low-voltage input terminal i9, and the first pole of the eleventh thin film transistor T54 respectively. A first pole and a gate of the ninth thin film transistor T51 both are connected to the first low-frequency clock signal input terminal i7. A second pole of the ninth thin film transistor T51 is connected to a first pole of the twelfth thin film transistor T52. A first pole, a second pole, and a gate of the tenth thin film transistor T53 are connected to the first low-frequency clock signal input terminal i7, the first pole of the eleventh thin film transistor T54, and the first pole of the twelfth thin film transistor T52 respectively. A second pole and a gate of the eleventh thin film transistor T54 are connected to the DC low-voltage input terminal i9 and the first node m respectively. A second pole and a gate of the twelfth thin film transistor T52 are connected to the DC low-voltage input terminal i9 and the first node m respectively.

In the above described first pull-down holding circuit, the sixth thin film transistor T42' and the seventh thin film transistor T42 are connected to each other in series, and thus the leakage current at point Q is further reduced. Besides, since the sixth thin film transistor T42' and the seventh thin film transistor T42 are connected in series, a voltage carried by the sixth thin film transistor T42' or the seventh thin film transistor T42 can be reduced. Therefore, a deterioration rate of the sixth thin film transistor T42' or the seventh thin film transistor T42 can be reduced to a certain extent, and thus a service life the sixth thin film transistor T42' or the seventh thin film transistor T42 can be prolonged. Furthermore, stability of the GOA circuit can be improved in harsh environments, and reliability of the liquid crystal panel can be enhanced.

In further another embodiment of the present disclosure, the second pull-down holding circuit 52 comprises a thirteenth thin film transistor T43', a fourteenth thin film transistor T43, a fifteenth thin film transistor T33, a sixteenth thin film transistor T61, a seventeenth thin film transistor T63, an eighteenth thin film transistor T64, and a nineteenth thin film transistor T62. A first pole, a second pole, and a gate of the thirteenth thin film transistor T43' are connected to the first node m, a first pole of the fourteenth thin film transistor T43, and a first pole of the eighteenth thin film transistor T64 respectively. A second pole and a gate of the fourteenth thin film transistor T43 are connected to the DC low-voltage input terminal i9 and the first pole of the eighteenth thin film transistor T64 respectively. A first pole, a second pole, and a gate of the fifteenth thin film transistor T33 are connected to the first signal output terminal o1, the DC low-voltage input terminal i9, and the first pole of the eighteenth thin film transistor T64 respectively. A first pole and a gate of the sixteenth thin film transistor T61 both are connected to the second low-frequency clock signal input terminal i8. A second pole of the sixteenth thin film transistor T61 is connected to a first pole of the nineteenth thin film transistor T62. A first pole, a second pole, and a gate of the seventeenth thin film transistor T63 are connected to the second low-frequency clock signal input terminal i8, the first pole of the eighteenth thin film transistor T64, and the first pole of the nineteenth thin film transistor T62 respectively. A second pole and a gate of the eighteenth thin film transistor T64 are connected to the DC low-voltage input terminal i9 and the first node m respectively. A second pole and a gate of the nineteenth thin film transistor T62 are connected to the DC low-voltage input terminal i9 and the first node m respectively.

Figure 5:
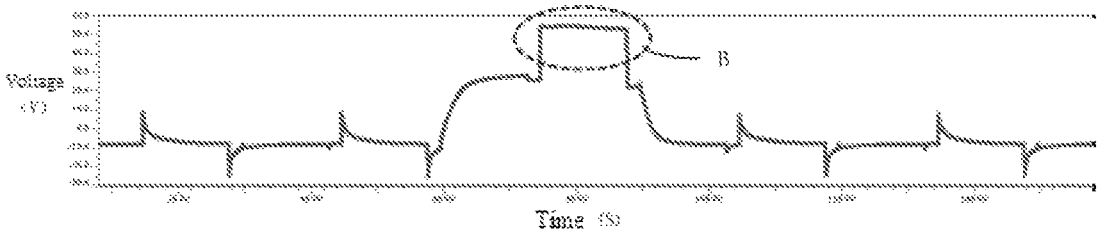
FIG. 5 schematically shows a waveform of a voltage at point Q in a GOA circuit according to the embodiment of the present disclosure.

In the above described second pull-down holding circuit, the thirteenth thin film transistor T43' and the fourteenth thin film transistor T43 are connected to each other in series, and thus the leakage current at point Q is further reduced. Besides, since the thirteenth thin film transistor T43' and the fourteenth thin film transistor T43 are connected in series, a voltage carried by the thirteenth thin film transistor T43' or the fourteenth thin film transistor T43 can be reduced. Therefore, a deterioration rate of the thirteenth thin film transistor T43' or the fourteenth thin film transistor T43 can be reduced to a certain extent, and thus a service life of the thirteenth thin film transistor T43' or the fourteenth thin film transistor T43 can be prolonged. Furthermore, stability of the GOA circuit can be improved in harsh environments, and reliability of the liquid crystal panel can be enhanced. FIG. 5 schematically shows a waveform of a voltage at point Q in a GOA circuit. It can be seen from FIG. 5 that, in the GOA circuit provided in the present embodiment, a voltage at point Q can be maintained, as shown by B in FIG. 5.

In a specific embodiment of the present disclosure, the transfer unit 3 comprises a twentieth thin film transistor T22. A first pole, a second pole, and a gate of the twentieth thin film transistor T22 are connected to the high-frequency clock signal input terminal i4, the second signal output terminal o2, and the first node m respectively. The transfer unit 3 is configured to provide a voltage signal to a second signal input terminal i2 of a GOA sub-circuit in another stage, i.e., an output signal of a second signal output terminal o2 of the transfer unit 3 is configured to serve as a start signal of a GOA sub-circuit in another stage.

In a specific embodiment of the present disclosure, the pull-up unit 2 comprises a twenty-first thin film transistor T21. A first pole, a second pole, and a gate of the twentieth thin film transistor T21 are connected to the high-frequency clock signal input terminal i4, the first signal output terminal o1, and the first node m respectively. The pull-up unit 2 is mainly configured to output a high-frequency clock signal CK (one of CK1-CK4) input to the high-frequency clock signal input terminal i4 as an $N^{th}$ gate signal G(N).

In a specific embodiment of the present disclosure, the bootstrap unit 6 comprises a capacitor Cb. A first end of the capacitor Cb is connected to the first node m, and the second end the capacitor Cb is connected to the first signal output terminal o1.

In the above described thin film transistors, a first pole is a drain, and a second pole is a source.

An embodiment of the present disclosure further provides a liquid crystal display device which comprises the GOA circuit described in the above embodiments.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A GOA circuit, comprising multiple stages of GOA sub-circuits connected in cascade, wherein each of the GOA sub-circuits comprises a pull-up control unit, a pull-up unit, a transfer unit, a pull-down unit, a pull-down holding unit, and a bootstrap unit, wherein the pull-up control unit is connected to a first signal input terminal, a second signal input terminal and a first node, and is configured to output a voltage signal of the second signal input terminal to the first node under control of the first signal input terminal;

wherein the pull-up unit is connected to a high-frequency clock signal input terminal, a first signal output terminal and the first node, and is configured to input a clock signal of the high-frequency clock signal input terminal to the first signal output terminal, wherein the transfer unit is connected to the high-frequency clock signal input terminal, the first node and a second signal output terminal, and is configured to provide a voltage signal to a second signal input terminal of a GOA sub-circuit in another stage;

wherein the pull-down holding unit is connected to the first node, a DC low-voltage input terminal, a first low-frequency clock signal input terminal, a second low-frequency clock signal input terminal and the first signal output terminal, and is configured to hold an output signal of the first signal output terminal at a low level;

wherein the bootstrap unit is connected to the first node and the first signal output terminal, and is configured to raise a voltage at the first node; and wherein the pull-down unit comprises a first thin film transistor, a second thin film transistor, and a third thin film transistor, wherein a first pole, a second pole, and a gate of the first thin film transistor are connected to the first node, a first pole of the second thin film transistor, and a third signal input terminal respectively;

wherein a second pole and a gate of the second thin film transistor are connected to the DC low-voltage input terminal and the third signal input terminal respectively; and wherein a first pole, a second pole, and a gate of the third thin film transistor are connected to the first signal output terminal, the DC low-voltage input terminal, and the third signal input terminal respectively;

wherein the pull-down holding unit comprises a first pull-down holding circuit and a second pull-down holding circuit, wherein the first pull-down holding circuit is connected to the first node, the DC low-voltage input terminal, the first low-frequency clock signal input terminal and the first signal output terminal, and is configured to hold an output signal of the first signal output terminal at a low level;

wherein the second pull-down holding circuit is connected to the first node, the DC low-voltage input terminal, the second low-frequency clock signal input terminal and the first signal output terminal, and is configured to hold the output signal of the first signal output terminal at a low level;

wherein the first pull-down holding circuit comprises a sixth thin film transistor, a seventh thin film transistor, an eighth thin film transistor, a ninth thin film transistor, a tenth thin film transistor, an eleventh thin film transistor, and a twelfth thin film transistor, wherein a first pole, a second pole, and a gate of the sixth thin film transistor are connected to the first node, a first pole of the seventh thin film transistor, and a first pole of the eleventh thin film transistor respectively;

wherein a second pole and a gate of the seventh thin film transistor are connected to the DC low-voltage input terminal and the first pole of the eleventh thin film transistor respectively;

wherein a first pole, a second pole, and a gate of the eighth thin film transistor are connected to the first signal output terminal, the DC low-voltage input terminal, and the first pole of the eleventh thin film transistor respectively;

wherein a first pole and a gate of the ninth thin film transistor both are connected to the first low-frequency clock signal input terminal, and a second pole thereof is connected to a first pole of the twelfth thin film transistor;

wherein a first pole, a second pole, and a gate of the tenth thin film transistor are connected to the first low-frequency clock signal input terminal, the first pole of the eleventh thin film transistor, and the first pole of the twelfth thin film transistor respectively;

wherein a second pole and a gate of the eleventh thin film transistor are connected to the DC low-voltage input terminal and the first node respectively; and wherein a second pole and a gate of the twelfth thin film transistor are connected to the DC low-voltage input terminal and the first node respectively.

2. The GOA circuit according to claim 1, wherein the pull-up control unit comprises a fourth thin film transistor and a fifth thin film transistor, wherein a first pole, a second pole, and a gate of the fourth thin film transistor are connected to the second signal input terminal, a first pole of the fifth thin film transistor, and the first signal input terminal respectively; and wherein a second pole and a gate of the fifth thin film transistor are connected to the first node and the first signal input terminal respectively.

3. The GOA circuit according to claim 1, wherein the second pull-down holding circuit comprises a thirteenth thin film transistor, a fourteenth thin film transistor, a fifteenth thin film transistor, a sixteenth thin film transistor, a seventeenth thin film transistor, an eighteenth thin film transistor, and a nineteenth thin film transistor, wherein a first pole, a second pole, and a gate of the thirteenth thin film transistor are connected to the first node, a first pole of the fourteenth thin film transistor, and a first pole of the eighteenth thin film transistor respectively;

wherein a second pole and a gate of the fourteenth thin film transistor are connected to the DC low-voltage input terminal and the first pole of the eighteenth thin film transistor respectively;

wherein a first pole, a second pole, and a gate of the fifteenth thin film transistor are connected to the first signal output terminal, the DC low-voltage input terminal, and the first pole of the eighteenth thin film transistor respectively;

wherein a first pole and a gate of the sixteenth thin film transistor both are connected to the second low-frequency clock signal input terminal, and a second pole thereof is connected to a first pole of the nineteenth thin film transistor;

wherein a first pole, a second pole, and a gate of the seventeenth thin film transistor are connected to the second low-frequency clock signal input terminal, the first pole of the eighteenth thin film transistor, and the first pole of the nineteenth thin film transistor respectively;

wherein a second pole and a gate of the eighteenth thin film transistor are connected to the DC low-voltage input terminal and the first node respectively; and wherein a second pole and a gate of the nineteenth thin film transistor are connected to the DC low-voltage input terminal and the first node respectively.

4. The GOA circuit according to claim 3, wherein the bootstrap unit comprises a capacitor, a first end of which is connected to the first node, and a second end of which is connected to the first signal output terminal.

5. The GOA circuit according to claim 3, wherein the first pole is a drain, and the second pole is a source.

6. The GOA circuit according to claim 1, wherein the transfer unit comprises a twentieth thin film transistor, a first pole, a second pole, and a gate of which are connected to the high-frequency clock signal input terminal, the second signal output terminal, and the first node respectively.

7. The GOA circuit according to claim 1, wherein the pull-up unit comprises a twenty-first thin film transistor, a first pole, a second pole, and a gate of which are connected to the high-frequency clock signal input terminal, the first signal output terminal, and the first node respectively.

8. The GOA circuit according to claim 1, wherein the bootstrap unit comprises a capacitor, a first end of which is connected to the first node, and a second end of which is connected to the first signal output terminal.

9. The GOA circuit according to claim 1, wherein the first pole is a drain, and the second pole is a source.

10. A liquid crystal display device, comprising a GOA circuit, wherein the GOA circuit comprises multiple stages of GOA sub-circuits connected in cascade, and each of the GOA sub-circuits comprises a pull-up control unit, a pull-up unit, a transfer unit, a pull-down unit, a pull-down holding unit, and a bootstrap unit, wherein the pull-up control unit is connected to a first signal input terminal, a second signal input terminal and a first node, and is figured to output a voltage signal of the second signal input terminal to the first node under control of the first signal input terminal;

wherein the pull-up unit is connected to a high-frequency clock signal input terminal, a first signal output terminal and the first node, and is configured to input a clock signal of the high-frequency clock signal input terminal to the first signal output terminal;

wherein the transfer unit is connected to the high-frequency clock signal input terminal, the first node and a second signal output terminal, and is configured to provide a voltage signal to a second signal input terminal of a GOA sub-circuit in another stage;

wherein the pull-down holding unit is connected to the first node, a DC low-voltage input terminal, a first low-frequency clock signal input terminal, a second low-frequency clock signal input terminal and the first signal output terminal, and is configured to hold an output signal of the first signal output terminal at a low level;

wherein the bootstrap unit is connected to the first node and the first signal output terminal, and is configured to raise a voltage at the first node; and wherein the pull-down unit comprises a first thin film transistor, a second thin film transistor, and a third thin film transistor, wherein a first pole, a second pole, and a gate of the first thin film transistor are connected to the first node, a first pole of the second thin film transistor, and a third signal input terminal respectively;

wherein a second pole and a gate of the second thin film transistor are connected to the DC low-voltage input terminal and the third signal input terminal respectively; and wherein a first pole, a second pole, and a gate of the third thin film transistor are connected to the first signal output terminal, the DC low-voltage input terminal, and the third signal input terminal respectively;

wherein the pull-down holding unit comprises a first pull-down holding circuit and a second pull-down holding circuit, wherein the first pull-down holding circuit is connected to the first node, the DC low-voltage input terminal, the first low-frequency clock signal input terminal and the first signal output terminal, and is configured to maintain the output signal of the first signal output terminal at a low level;

wherein the second pull-down holding circuit is connected to the first node, the DC low-voltage input terminal, the second low-frequency clock signal input terminal and the first signal output terminal, and is configured to hold the output signal of the first signal output terminal at a low level;

wherein the first pull-down holding circuit comprises a sixth thin film transistor, a seventh thin film transistor, an eighth thin film transistor, a ninth thin film transistor, a tenth thin film transistor, an eleventh thin film transistor, and a twelfth thin film transistor, wherein a first pole, a second pole, and a gate of the sixth thin film transistor are connected to the first node, a first pole of the seventh thin film transistor, and a first pole of the eleventh thin film transistor respectively;

wherein a second pole and a gate of the seventh thin film transistor are connected to the DC low-voltage input terminal and the first pole of the eleventh thin film transistor respectively;

wherein a first pole, a second pole, and a gate of the eighth thin film transistor are connected to the first signal output terminal, the DC low-voltage input terminal, and the first pole of the eleventh thin film transistor respectively;

wherein, a first pole and a gate of the ninth thin film transistor both are connected to the first low-frequency clock signal input terminal, and a second pole thereof is connected to a first pole of the twelfth thin film transistor;

wherein a first pole, a second pole, and a gate of the tenth thin film transistor are connected to the first low-frequency clock signal input terminal, the first pole of the eleventh thin film transistor, and the first pole of the twelfth thin film transistor respectively;

wherein a second pole and a gate of the eleventh thin film transistor are connected to the DC low-voltage input terminal and the first node respectively; and wherein a second pole and a gate of the twelfth thin film transistor are connected to the DC low-voltage input terminal and the first node respectively.

11. The liquid crystal display device according to claim 10, wherein the pull-up control unit comprises a fourth thin film transistor and a fifth thin film transistor, wherein a first pole, a second pole, and a gate of the fourth thin film transistor are connected to the second signal input terminal, a first pole of the fifth thin film transistor, and the first signal input terminal respectively; and wherein a second pole and a gate of the fifth thin film transistor are connected to the first node and the first signal input terminal respectively.

12. The liquid crystal display device according to claim 10, wherein the second pull-down holding circuit comprises a thirteenth thin film transistor, a fourteenth thin film transistor, a fifteenth thin film transistor, a sixteenth thin film transistor, a seventeenth thin film transistor, an eighteenth thin film transistor, and a nineteenth thin film transistor, wherein a first pole, a second pole, and a gate of the thirteenth thin film transistor are connected to the first node, a first pole of the fourteenth thin film transistor, and a first pole of the eighteenth thin film transistor respectively;

wherein a second pole and a gate of the fourteenth thin film transistor are connected to the DC low-voltage input terminal and the first pole of the eighteenth thin film transistor respectively;

wherein a first pole, a second pole, and a gate of the fifteenth thin film transistor are connected to the first signal output terminal, the DC low-voltage input terminal, and the first pole of the eighteenth thin film transistor respectively;

wherein, a first pole and a gate of the sixteenth thin film transistor both are connected to the second low-frequency clock signal input terminal, and a second pole thereof is connected to a first pole of the nineteenth thin film transistor;

wherein a first pole, a second pole, and a gate of the seventeenth thin film transistor are connected to the second low-frequency clock signal input terminal, the first pole of the eighteenth thin film transistor, and the first pole of the nineteenth thin film transistor respectively;

wherein a second pole and a gate of the eighteenth thin film transistor are connected to the DC low-voltage input terminal and the first node respectively; and wherein a second pole and a gate of the nineteenth thin film transistor are connected to the DC low-voltage input terminal and the first node respectively.

13. The liquid crystal display device according to claim 10, wherein the transfer unit comprises a twentieth thin film transistor, a first pole, a second pole, and a gate of which are connected to the high-frequency clock signal input terminal, the second signal output terminal, and the first node respectively.

14. The liquid crystal display device according to claim 10, wherein the pull-up unit comprises a twenty-first thin film transistor, a first pole, a second pole, and a gate of which are connected to the high-frequency clock signal input terminal, the first signal output terminal, and the first node respectively.

15. The liquid crystal display device according to claim 10, wherein the bootstrap unit comprises a capacitor, a first end of which is connected to the first node, and the second end of which is connected to the first signal output terminal.

16. The liquid crystal display device according to claim 10, wherein the first pole is a drain, and the second pole is a source.

* * * * *